US005433433A

United States Patent [19]

Armell

[11] Patent Number: 5,433,433

[45] Date of Patent: Jul. 18, 1995

[54] FLEXIBLE SPORTS GOAL

[76] Inventor: Robert S. Armell, 199 Clark Rd., Brookline, Mass. 02146

[21] Appl. No.: 253,501

[22] Filed: Jun. 3, 1994

[51] Int. Cl.[6] ..... A63B 69/00

[52] U.S. Cl. ..... 273/26 A

[58] Field of Search ..... 273/26 A, 127 B, 400, 273/392

[56] References Cited

U.S. PATENT DOCUMENTS 4,339,132 7/1982 Stevens ..... 273/127 B 4,579,344 4/1986 Meggs ..... 273/127 B

*Primary Examiner*—Theatrice Brown

*Attorney, Agent, or Firm*—William Nitkin

[57] ABSTRACT

A sports goal made of a generally unitary, elongated, flexible wire member formed into a vertically disposed U-shaped portion, bending at a substantially right angle to a horizontally disposed U-shaped portion. A strap can join the bent portions of the wire member to be in a spaced apart relation to one another. A net member can extend from the vertically disposed U-shaped member to the horizontally disposed U-shaped member, forming an open mouth to receive a game playing object therein.

9 Claims, 2 Drawing Sheets

FLEXIBLE SPORTS GOAL

BACKGROUND OF THE INVENTION

1. Field of the Invention

The structure of this invention resides in the area of sports goals and more particularly relates to a portable, flexible sports goal that is lightweight and which when struck by an individual or an object with sufficient force will yield by flexing and when such force thereagainst ceases, will re-erect itself.

2. Description of the Prior Art

Many games utilizing sports goals are often played informally in fields and areas which do not have standard goal structures. Because such games are often impromptu gatherings, it is difficult and usually impossible for the players to bring conventional, full-size goals which for the most part are installed in permanent locations on fields or playing areas. In such situations players will often use non-standard structures as goals such as stakes, T-shirts or any visible object which can be used to define a goal area for the purpose of the game. For example, if soccer is played or other similar sport where a ball or other game playing object must pass into a goal in order to score points, the ball or other game playing object can be directed between two markers in order to provide a scoring situation. Many times though when informal goals are used, disagreements can arise among players as to whether points have been scored based on whether the game playing object has passed outside or above the informal goal.

To address the above concerns, portable sports goals utilizing various frameworks have been developed in the prior art.

SUMMARY OF THE INVENTION

It is an object of this invention to provide an inexpensive, lightweight, flexible and self-contained portable sports goal which can be used in an informal game of soccer or other goal-requiring game which sports goal is an alternative to the Portable Sports Goal described in my U.S. Pat. No. 5,244,213 disclosing first and second poles held at 90 degrees to one another by attachment members pulled together by a strap. In the present invention the framework can be instantly set up for use and quickly and easily folded for storage. Since there are no separate parts of the sports goal of the present invention, there is no possibility of loss of portions of the sports goal either in its use mode or in its storage mode.

It is a further object of the sports goal of this invention, when in its use mode, to be extremely lightweight and portable so that it can be carried and moved by hand. When it Is desired that the sports goal be placed in its storage mode, it can be easily folded and stored.

It is a still further object of this invention that the vertical, upright portion of the sports goal be resiliently yielding when struck by a player or game playing object. This safety feature allows the vertical portion of the structure to yield when sufficient external pressure is applied against it and to spring back to its original vertical upright position when such pressure ceases.

To accomplish these objects, the sports goal of this invention is provided with a wire frame permanently bent at the same 90-degree angle at two opposite sides and maintained in an arcuately bowed state by the shape of the wire frame or, if the wire frame generally forms a circular shape, by a strap or other member, such as a floor, extending between, and attached to, the two bends. Such structure forms two U-shaped portions, one resting horizontally on the ground defining a base and the other vertically disposed with a net member interconnecting such horizontal U-shaped portion to the upright, goal opening or mouth. The wire frame can be made of narrow-gauge, spring steel wire or rod so that when sufficient pressure is placed against the vertical U-shaped portion, the vertical U-shaped portion bends rearward and/or sideways toward the horizontal U-shaped portion. The vertical U-shaped portion will return to its upright position when pressure thereagainst, such as from a player falling on the structure or a ball striking the structure, ceases. It should be noted that the sports goal of this invention can receive a ball, puck or other game playing object used in the game being played.

DESCRIPTION OF THE PREFERRED EMBODIMENT(S)

The framework of the sports goal of this invention can be made of generally unitary construction in a new pre-formed configurationn to produce a sports goal that is lightweight and portable and which can be instantly set-up and easily folded for storage. The sports goal can withstand pressure thereagainst such as from individuals falling against it without breaking and will spring back to its original position once such pressure ceases.

Figure 1:
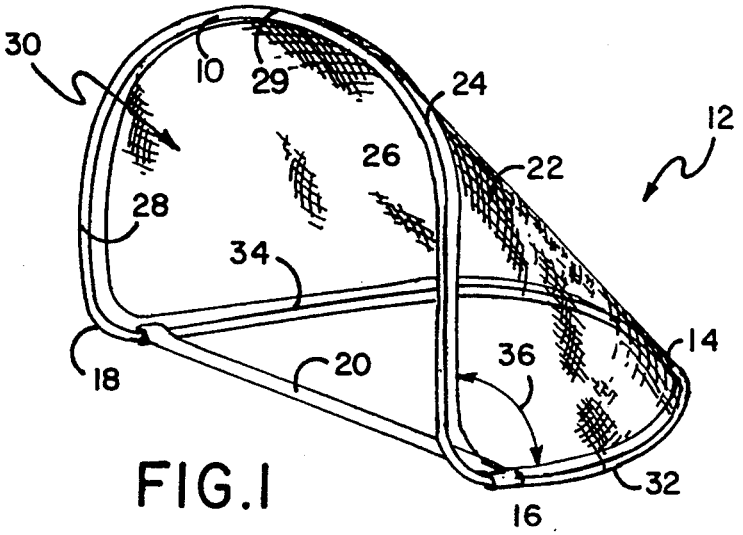
FIG. 1 illustrates a perspective view of the portable sports goal of this invention.
Figure 2:
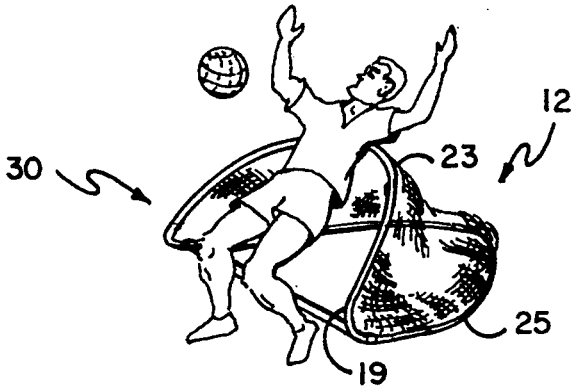
FIG. 2 illustrates a perspective view of the portable sports goal of this invention having a floor with an individual falling against the vertical U-shaped portion thereof.
Figure 6:
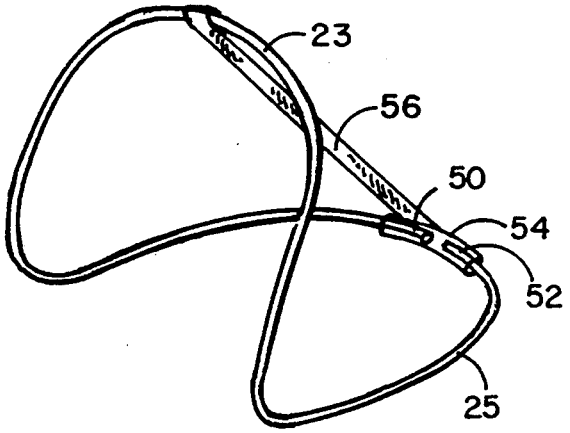
FIG. 6 illustrates the wire framework of the sports goal with a retention strap utilized in place of a net.

FIG. 1 illustrates a perspective view of sports goal 12 of this invention which is shown having wire 10 which can be a spring steel wire, rod or equivalent being approximately 3/16 inch in diameter bent to form first and second bends 16 and 18. Wire 10 has first and second ends 50 and 52 seen in FIG. 6 which ends are joined by welding or equivalent joining means to first form, in one embodiment, a generally circular wire configuration. Extending between the internal portions of wire 10 is net member 22. Wire 10 can be contained within sleeve 24, as seen in FIG. 1, which can be fabric or other equivalent flexible material to which net member 22 can be attached. Right-angled first and second bends 16 and 18 are positioned approximately opposite one another in wire 10. Strap 20 pulls first and second bends 16 and 18 inward which strap 20 can be attached to the wire or to sleeve 24, forming horizontally disposed U-shaped member 25 to be placed on the ground when in use having first and second horizontal side members 32 and 34 which curve around to end portion 14, and generally vertically disposed U-shaped member 23 formed by vertical side members 26 and 28 curving around to top portion 29. The vertical and horizontal U-shaped members are also illustrated in FIG. 6. These members are not discrete, separate members but are continuous as the sports goal structure is formed of a single piece of wire which is flexible. Vertical U-shaped member 23 forms opening or mouth 30 of the sports goal into which the ball or other game playing object passes for scoring purposes. Angle 36 at both bends between horizontal U-shaped member 25 and vertical U-shaped member 23 can be approximately 90 degrees in a preferred embodiment. When strap 20 or equivalent attachment means, such as floor 19 seen in FIG. 2, is attached at such bends, it pulls the angularly bent portions of the wire toward one another, which bent portions are disposed opposite one another on wire 10 if the wire were considered a circular structure. Net member 22 is structured to be taut between horizontal U-shaped member 25 and vertical U-shaped member 23. If floor 19 is used, it can extend and be attached to the sleeve around horizontal U-shaped member 25. In some embodiments net member 22 can be replaced by a second retention strap 56, as seen in FIG. 6, extending from top portion 29 of vertical U-shaped member 23 to end portion 14 of horizontal U-shaped member 25 which net replacement will lighten the weight of the sports goal.

Figure 3:
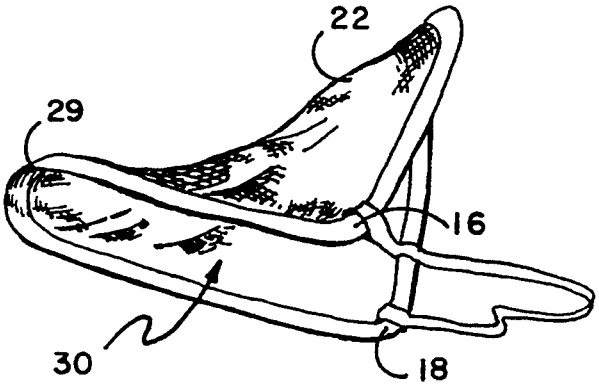
FIG. 3 illustrates the beginning of the folding process of the portable sports goal of this invention prior to storing the structure.
Figure 4:
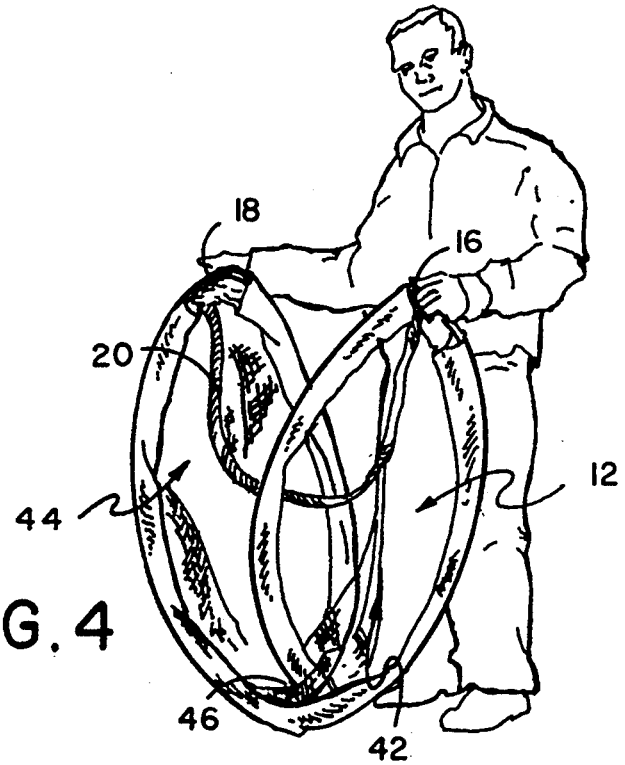
FIG. 4 illustrates the continuation of the folding process of FIG. 3 wherein the structure is twisted and grasped at the angular bends and brought together.
Figure 5:
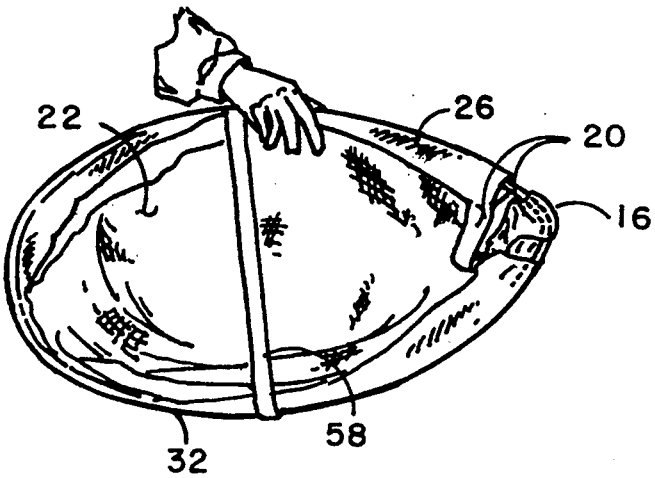
FIG. 5 illustrates the portable sports goal of this invention in its folded mode for storage.

In FIG. 2 one can see an individual falling against vertical U-shaped member 23 such that vertical U-shaped member 23 is bent rearwards, causing wrinkling of net member 22. Vertical U-shaped member 23 will spring back into its vertical position because off,the resilient nature of the spring steel wire when the individual no longer makes contact with the sports goal. The vertical U-shaped member cannot move further away from the horizontal U-shaped member because of the predetermined length of net member 22 or second retention strap 56 between top portion 29 of vertical U-shaped member 23 and end portion 14 of the horizontal U-shaped member 25 which net length helps maintain vertical U-shaped member 23 at an approximately 90-degree angle to horizontal U-shaped member 25. Because of its simplicity of design, my new invention is inexpensive to manufacture. For storage purposes the wire framework of the structure of this invention is not usually separated from the net member and sleeve, but the structure can be easily twisted and folded for storage and carrying by bringing first and second bends 16 and 18 towards each other, as seen in FIG. 3. As first and second bends 16 and 18 are being brought together, the structure essentially twists of its own accord and forms two loops of the continuous spring steel wire, being first loop 42 and second loop 44 seen in FIG. 4 where spring steel wire 10 forms a bend at point 46. When first and second bends 16 and 18 are brought together, the two loops of wire, as described above, come together, as seen in FIG. 5, such that side members 32 and 26 are positioned in a oval shape with strap 20 then loosely disposed therebetween with net member 22 bunched up. A short strap 58 or equivalent restraining means can be used to retain the structure in its flattened, storage mode, as illustrated in FIG. 5, such that it can be easily stored in a substantially flat position for either shipping or transporting from place to place.

FIG. 6 illustrates wire 10 without the net member but having second retention strap 56 instead and shows the ends of the unitary, bent wire coming together within receipt member 54 with first and second ends 50 and 52 of wire 10 held securely within receipt member 54. This junction structure, though, is not usually seen when the sports goal of this invention is in use because the entire wire structure is usually contained within sleeve 24 which sleeve can also be attached to net 22 as seen in FIG. 1.

Although the present invention has been described with reference to particular embodiments, it will be apparent to those skilled in the art that variations and modifications can be substituted therefor without departing from the principles and spirit of the invention.

I claim:

1. A sports goal for receipt of a game playing object, comprising:

an elongated flexible member forming a vertically disposed U-shaped portion having a rear portion and an open end facing downward and an adjoining horizontally disposed U-shaped portion having an end portion and an open end, said horizontal U-shaped portion having contiguous junctions at its open end contiguous at approximately a right angle to said open end of said vertical U-shaped portion forming a bent member portion at each junction of said vertical and horizontal U-shaped portions, said vertical U-shaped portion having a top portion and an open mouth for receipt of said game playing object, said open end of said vertical U-shaped portion being adjacent to said open end of said horizontal U-shaped portion; and means to retain said bent member portions of said vertical and horizontal U-shaped portions in a spaced apart relation to one another.

2. The sports goal of claim 1 wherein said means to retain said bent member portions of said horizontal and vertical U-shaped portions together is a strap extending therebetween.

3. The sports goal of claim 2 further including connection means engaged to said elongated member, said connection means extending from said rear portion of said vertical U-shaped portion to said end portion of said horizontal U-shaped portion.

4. The sports goal of claim 3 wherein said connection means is a net member.

5. The sports goal of claim 4 further including a sleeve member around said flexible member to which sleeve member said net member is attached.

6. A sports goal for receipt of a game playing object, comprising:

a wire having a first end and a second end, said first and second ends joined together to form a generally circular structure having a perimeter, said wire having a first bend and a second bend, said bends disposed in the same direction and positioned opposite one another around said perimeter, each of said bends having an angle of bend of approximately 90 degrees;

attachment means attached between said first and second bends, said attachment means causing said circular wire to be maintained in an arcuately bowed state in its use mode and forming a first U-shaped member and a second U-shaped member, said first U-shaped member in its use mode being horizontally disposed and said second U-shaped member in its use mode being vertically disposed, said second U-shaped member defining an opening for receipt of said game playing object; and a net member attached to said wire structure, said net member extending between said first U-shaped member to said second U-shaped member.

7. The sports goal of claim 6 further including a sleeve member around said wire structure to which sleeve member said net member is attached.

8. The sports goal of claim 6 wherein said attachment means is a strap extending between said first and second bends of said wire.

9. The sports goal of claim 6 wherein said attachment means includes a floor member attached to, and extending from, one side of said first U-shaped member to the other.

* * * * *